US005218369A

United States Patent [19]

Jennings

[11] Patent Number: 5,218,369

[45] Date of Patent: Jun. 8, 1993

[54] ANTENNA QUICK RELEASE

[75] Inventor: William H. Jennings, Bedford, Va.

[73] Assignee: Ericsson GE Mobile Communications, Inc., Lynchburg, Va.

[21] Appl. No.: 735,045

[22] Filed: Jul. 24, 1991

[51] Int. Cl.[5] ..... H01Q 1/24

[52] U.S. Cl. ..... 343/702; 343/906

[58] Field of Search ..... 343/702, 906, 714, 715, 343/900, 901, 888; 439/916

[56] References Cited

U.S. PATENT DOCUMENTS

| | | | |
|---|---|---|---|
| 1,934,415 | 11/1933 | Fisher | 279/79 |
| 1,954,048 | 4/1934 | Jeffrey et al. | 279/78 |
| 2,200,396 | 5/1940 | Martin | 343/889 |
| 2,565,661 | 8/1951 | Udz | 343/702 |
| 3,378,273 | 4/1968 | Lewis et al. | 280/11.37 |
| 3,827,820 | 8/1974 | Hoffman | 403/165 |
| 3,897,647 | 8/1975 | Black | 43/42.38 |
| 3,946,317 | 3/1976 | Ishimaru et al. | 343/702 |
| 3,946,390 | 3/1976 | Alexander et al. | 343/702 |
| 3,973,202 | 8/1976 | Gardner | 325/313 |
| 4,024,542 | 5/1977 | Ikawa et al. | 343/702 |
| 4,261,788 | 4/1981 | McClung | 156/541 |
| 4,391,160 | 7/1983 | Myers | 74/551.8 |
| 4,392,759 | 7/1983 | Cook | 403/327 |
| 4,920,352 | 4/1990 | Martensson et al. | 343/702 |
| 4,989,012 | 1/1991 | Martensson et al. | 343/702 |

FOREIGN PATENT DOCUMENTS

| | | | |
|---|---|---|---|
| 0147806 | 11/1980 | Japan | 343/702 |

*Primary Examiner*—Rolf Hille
*Assistant Examiner*—Hoanganh Le
*Attorney, Agent, or Firm*—Nixon & Vanderhye

[57] ABSTRACT

An improved antenna mounting is designed to quickly release an antenna or antenna lead from a portable radio cabinet. The mounting assembly releasably locks the antenna in place by a spring loaded quick release mechanism in both the axial and radial dimensions.

16 Claims, 3 Drawing Sheets

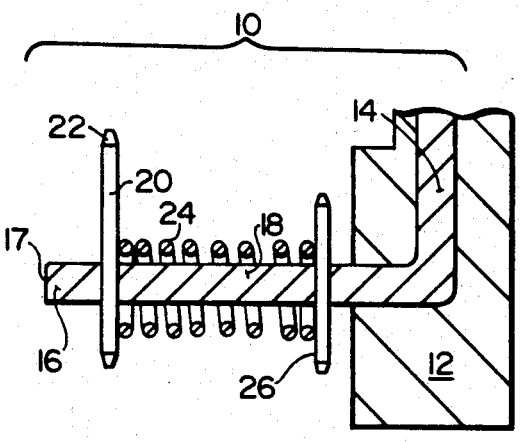
Fig. 1
Fig. 2
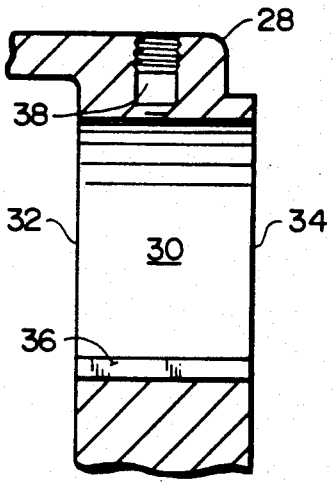
Fig. 3
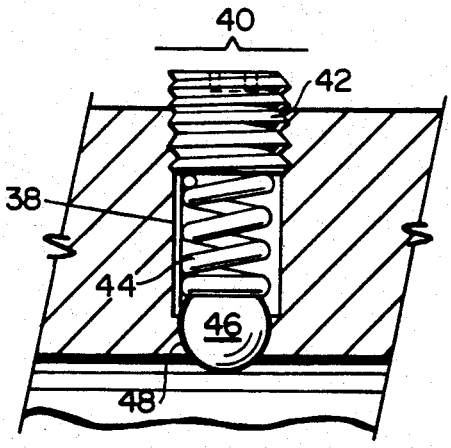
Fig. 4
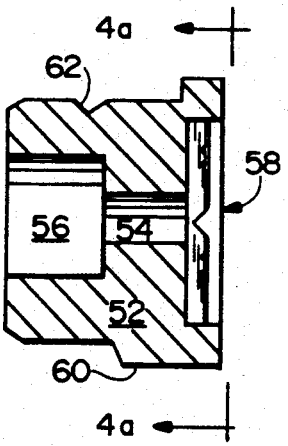
Fig. 4 a
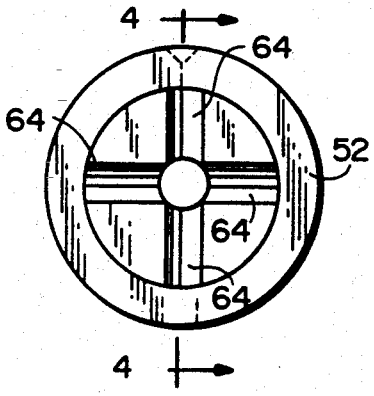

ANTENNA QUICK RELEASE

FIELD OF THE INVENTION

This invention relates generally to a quick release antenna mounting or antenna lead connection for portable radio communications equipment.

BACKGROUND AND SUMMARY OF THE INVENTION

Portable communications equipment, e.g. radios and cellular telephones, hereinafter radios, are typically provided with an antenna for radiating and receiving radio frequency electromagnetic waves. In constructing such radios, it presently is customary for the antenna to be installed internally of the apparatus. In other instances a mount, for an antenna, is provided on the outside of the housing. These mountings may be permanently affixed to or integrally molded with the radio cabinet.

Oftentimes, inadvertent accidents occur which cause the antenna to break away from its mounting. Repair or replacement of an antenna which is installed inside the radio requires a rather involved process of opening up the cabinet to correct the damaged mount and to remove the remaining remnants of the shattered antenna. In addition, radios which have antennas mounted inside the housing may be vulnerable to internal damage of the radio components because of forces encountered in such an accident.

Externally mounted antennas which are broken off may require discarding the entire cabinet if the mount has been formed or molded integrally with the housing.

A current desire exists, especially for cellular phones, to be able to change signal radiating and receiving antennas. The ability to quickly switch from the portable radio antenna to the lead of a remotely mounted antenna (e.g. an automobile antenna) also would increase the overall utility of cellular phones. Most prior portable communication devices having permanently fixed antennas are presently incapable of quickly switching to use a remotely mounted antenna. Of course it would be especially beneficial to permit quick detachment of a disabled antenna or antenna lead (e.g. in an event of accidental breakage) and reconnection of a new antenna or antenna lead. In general, a need exists for a portable radio user to readily detach and subsequently reattach an antenna or antenna lead wire. To achieve this desired result, a quick release mechanical and RF electrical coupling must be effected.

Quick release couplings of numerous types have been utilized in numerous mechanical devices. One classical quick release coupling involves a spring-loaded ball cooperating with a detent on a rod or shaft, thereby holding it in a locked position. Upon exerting sufficient force, the spring compresses and unseats the ball to enable shaft detachment. Quick release couplings of this nature are generally illustrated in the following U.S. Patents: Fisher, U.S. Pat. No. 1,934,415, issued Nov. 7, 1933; Jeffrey et al, U.S. Pat. No. 1,954,048, issued Apr. 10, 1934, Lewis et al, U.S. Pat. No. 3,378,273, issued Apr. 16, 1968; Hoffman, U.S. Pat. No. 3,827,820, issued Aug. 6, 1974; Black, U.S. Pat. No. 3,897,647, issued Aug. 5, 1975, Gardner, U.S. Pat. No. 3973,202, issued Aug. 3, 1976; McClung, U.S. Pat. No. 4,261,788, issued Apr. 14, 1981; Myers, U.S. Pat. No. 4,391,160, issued Jul. 5, 1983 and Cook U.S. Pat. No. 4,392,759, issued Jul. 12, 1983. While the art is illustrative of various applications for quick release mechanical couplings, it appears that such quick release couplings have not yet been utilized in constructing radio frequency antenna mountings for portable radio communications equipment.

The present invention provides a novel and improved antenna mounting specifically designed to quickly release the antenna or antenna lead from the portable radio cabinet. It will be appreciated that the "antenna" hereinafter referred to may include either an antenna structure or a lead connection.

The exemplary embodiment of this invention uses a spring-loaded toroidal adapter axially slidable about an RF conductive shaft having an RF connector at one end and integral with the RF antenna at the other end. The outer surface of the adapter is configured to fit within a mated opening in a portable radio cabinet. The adapter includes surface features to effect a quick release locking to both rotational and axial movements with respect to the housing opening. At the same time, the adapter includes a multiple position detent to permit selective rotational antenna movements to any of plural predetermined quick release lock positions while the adapter itself remains fixed in the housing.

The exemplary antenna is provided with an RF conductive shaft and casing. An exposed portion of the conductive shaft extending beyond the casing has a retention pin through one end. The center of the retention pin is offset from the conductor shaft so that one end of the pin extends a radial distance greater than the other. A locking pin is located at the other end of the exposed conductor shaft.

The exemplary mounting adapter is sized and configured so as to receive the exposed conductor shaft. The mounting adapter is slidably positioned on the shaft between the retention and locking pins and is resiliently biased against the retention pin by a spring or other suitable resilient device (e.g. resilient gasket, cantilevered spring, and the like). The proximal end of the adapter (i.e. closest to the locking pin) is provided with a four-position detent locking arrangement. The locking pin seats within any of the four possible positions thereby preventing unwanted rotation except during the time of desired adjustment. The exemplary adapter is also provided with a protrusion which mates with or seats in a corresponding channel within a radio cabinet opening. A notch is also provided peripherally of the adapter so as to receive a spring-loaded ball carried by the cabinet.

The exemplary antenna and mounting adapter are assembled into one-piece and configured to be receivably engaged within a mated opening in the portable radio cabinet. To attach the connection, the adapter/antenna assembly is aligned with the mated radio cabinet opening (e.g. so that the adapter tab and the radially extended end of the retention pin line-up with the corresponding channel in the opening). The adapter/antenna assembly is then moved axially into the aligned cabinet opening. The retention pin passes completely through the opening, while the tab remains within the channel. Meanwhile, the adapter notch also has become aligned with the quick release device and the spring-loaded ball has become seated within the notch. The adapter/antenna assembly is now releasably locked within the radio cabinet.

In this locked position, relatively light outward pressure may now be exerted upon the antenna casing causing the antenna conductive shaft to be moved axially outwardly. The spring biased retention pin thus moves relative to the adapter thereby unseating the locking pin from the four-position detent locking arrangement. The antenna may then be rotated to one of a plurality of orientations.

When the axially-outward antenna pressure is released, the spring-loaded adapter causes the locking pin to seat within the selected position of the four-position locking arrangement while simultaneously effecting a good firm spring-loaded RF electrical connection at the distal end of the conductive shaft. Once the asymmetrically disposed retention pin has been thus rotated out of alignment with the corresponding channel in the radio cabinet opening, it also serves to safely lock the antenna to the cabinet by internally engaging the cabinet (e.g. just beyond the periphery of the mated opening).

Removal of the adapter/antenna assembly is effected in much the same way, whereby the adapter is first lightly pulled and rotated to align the retention pin with the mated opening channel. Thereafter, sufficient further pressure exerted upon the adapter/antenna assembly causes the radially spring-loaded ball of the quick release device to unseat and allows the whole adapter-/antenna assembly to be easily withdrawn from the cabinet.

Other objects and advantages of the invention will become apparent from the detailed description which follows.

BRIEF DESCRIPTION OF THE DRAWINGS

FIG. 1 is a cross-sectional of an exemplary antenna;

FIG. 2 is a cross-sectional view of an exemplary mated opening in a radio cabinet;

FIG. 3 is a cross-sectional view of an exemplary quick release mechanism for use in the opening of FIG. 2;

FIG. 4 is a cross-sectional view of the mounting adapter taken along lines 1–4 in FIG. 4*a;*

FIG. 4*a* is a front elevational view of the mounting adapter of FIG. 4 showing a four position detent recess;

DETAILED DESCRIPTION OF THE EXEMPLARY EMBODIMENT

Figure 5:
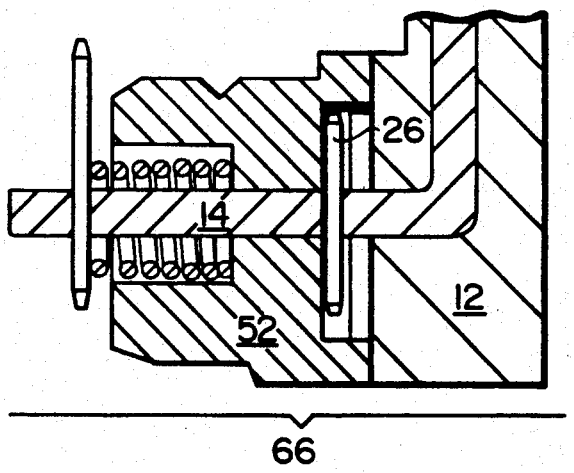
FIG. 5 is a cross-sectional view of the antenna quick connection including the assembled elements of FIGS. 1 and 4.

An antenna, generally designated 10 in FIG. 1, includes an outer casing 12 and conductor shaft 14. While conductor shaft 14 is illustrated at a right angle to casing 12, it is appreciated that conductor shaft 14 may rest at any suitable angle. Conductor shaft 14 has an exposed portion having first and second ends 16 and 18, respectively. First end 16 has a chamfered or tapered end 17 sized and configured so as to conventionally fit within a coaxial cable center conductor connector (not shown). A retention pin 20 is positioned in an asymmetrical or offset position (e.g. such that one end 22 of retention pin 20 extends a radial distance from the shaft 14 greater than does the other end so as to enable retention pin 20 to prevent unanticipated accidental removal of antenna 10 by internally engaging the cabinet just beyond the periphery of the mated opening). Spring 24 is positioned adjacent retention pin 20 and biases adapter 52 (depicted in FIG. 4) towards locking pin 26, which is selectively seated within one of the four position detents 64 of adapter 52 (depicted in FIG. 4*a*). The adapter 52 is itself biased by spring 24 against the casing 12 (when in the installed condition, FIG. 5).

A portable radio cabinet 28 (which may be constructed of metal, plastic or any other suitable material) is depicted in FIG. 2 as having opening 30, mated to fit adapter 52. Opening 30 further includes an axial registration channel 36 extending lengthwise of opening 30 and radial port 38 sized and configured so as to receive a quick release mechanism 40 as illustrated in FIG. 3.

Quick release mechanism 40 includes set screw 42, spring 44 and ball 46. Spring 44 is variably compressible in port 38 between set screw 42 and ball 46. End 48 of port 38 has tapered walls to prevent ball 46 from escaping. Set screw 42 is threadably received in port 38 opposite converging end 48 (e.g. towards end 50). Set screw 42 may increase or decrease the tension on spring 44 by being further driven down or up within port 38.

A mounting adapter for antenna 10 is designated 52 in FIG. 4 and has an aperture 54 and first and second open ends 56 and 58 respectively. Mounting adapter 52 has a radially and axially extending tab 60 and a notch 62. Tab 60 registers with cabinet channel 36 and an oppositely disposed notch 62 aligned with radial channel 38 so that the notch receives the spring biased ball 46 of quick release mechanism 40 thereby releasably locking the adapter within the radio cabinet, FIG. 6*c*. FIG. 4*a* illustrates an end view of second opening 58 showing a four position locking arrangement of radial detent channels 64.

The antenna connection, generally designated 66 in FIG. 5, is assembled as a single unit. The mounting adapter 52 is biased by spring 24 towards locking pin 26 attached to conductor shaft 14. The opposing pair of the four position detent locking channels 64 (depicted in FIGS. 4*a*).

Figure 6A:
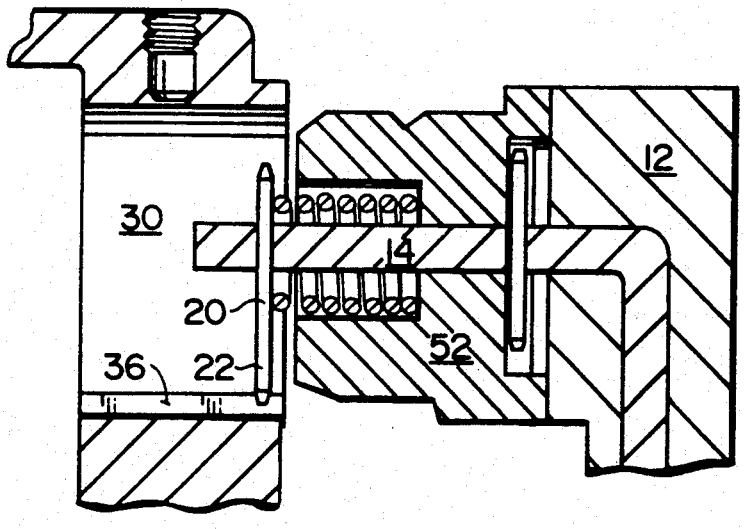
FIGS. 6*a*–6*c* are views showing the positioning, alignment and insertion of an exemplary antenna connection into a mated radio cabinet opening (including the assembled elements of FIGS. 2 and 3).

Referring now to FIG. 6*a*, antenna assembly 66 is positioned in alignment with opening 30 so that tab 60 and end 22 of retention pin 20 are aligned with channel 36. The adapter/antenna assembly 66 of FIG. 5, is then inserted into opening 30 so that end 22 of retention pin 20 passes completely through registration channel 36 while tab 60 becomes seated within the channel. When tab 60 of the adapter is fully inserted into channel 36, (FIG. 6*b*) notch 62 has become aligned with radial channel 38 whereby ball 46 of the quick release device 40 is seated within notch 62 thereby releasably locking mounting adapter 52 in axial position. The spring 24 now positively biases the free end 16 of RF conductive shaft 14 into RF connector socket 100.

Figure 6B:
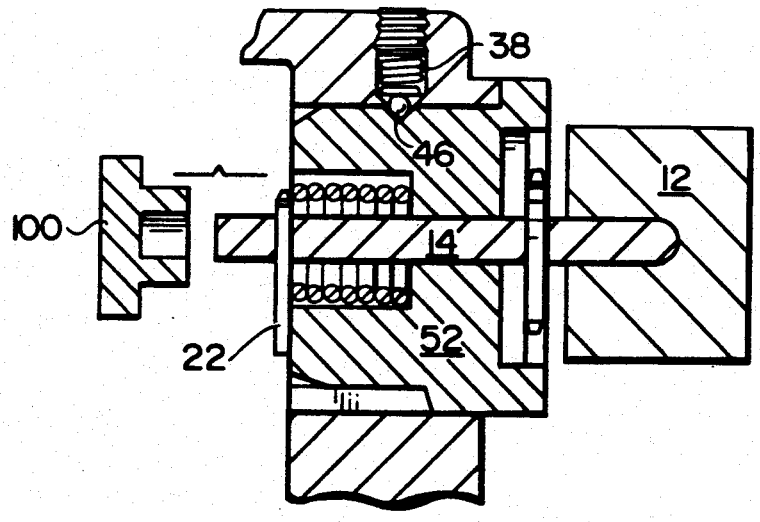
Figure 6C:
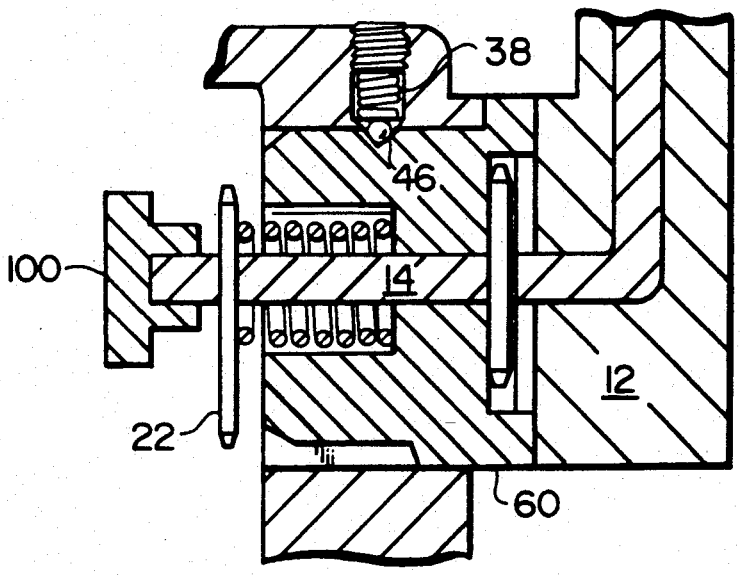

With mounting adapter 52 now locked into axial position, the user may change (if desired) the rotational orientation of antenna 10, as depicted in FIG. 6*b*. To do so, the user pulls antenna 10 slightly away from cabinet 28, while adapter 52 remains locked in position. This causes spring biased retention pin 20 to move towards the adapter 52 and unseat locking pin 26 from one of radial detent channels 64, (and also slightly unseating the RF connection 100). The radially extended end 22 of retention pin 20 engages the inner portion of cabinet 28 (just beyond the periphery of mated opening 30) so as to hold antenna 10 into cabinet 28 while it is rotated. Antenna 10 is now rotated to a desired one of the rotational detent positions. The pressure is then released allowing the spring-loaded retention pin 20 to pull the conductive antenna shaft back into a full connect position with locking pin 26 seated within one of radial detent channels 64, (while also reseating the RF connection). Of course, antenna 10 need not necessarily be rotated to complete a mechanical and RF electrical connection between antenna 10 and cabinet 28.

To remove antenna connection 66, outward pressure is again exerted on antenna 10. This causes locking pin 26 to again unseat from detent 64. Antenna 10 is then rotated (if necessary) to bring asymmetric retention pin 20 into registry with channel 36. Upon alignment of retention pin 20 with channel 36, and with spring 24 compressed, additional outward pressure is exerted on antenna 10 causing ball 46 to unseat from notch 62 thereby axially unlocking mounting adapter 52 and allowing retention pin 20 and registration tab 60 to travel outwardly through registration channel 36 until the antenna connection assembly 66 is entirely clear from the radio cabinet 28.

While the invention has been described in connection with only one exemplary embodiment, it will be understood that the invention is not limited to the disclosed embodiment, but on the contrary, is intended to include all modifications and equivalent arrangements which retain one or more novel features of this invention as defined by any of the appended claims.

What is claimed is:

1. A quick release antenna mount comprising:

an adapter axially slidable about an RF conductive shaft, said conductive shaft having an RF connection at one end and an RF antenna at the other end;

said adapter having an outer surface sized and configured to fit within a mated opening in a portable radio cabinet, said outer surface having means for effecting a quick release locking the adapter to both rotational and axial movements with respect to said mated opening in the radio cabinet, wherein said locking means includes a radially outwardly extending tab and a radially inwardly extending notch on the outer surface of the adapter; and said adapter further including a multiple position detent to permit selective rotational movements of the RF conductive shaft to a plurality of predetermined positions with respect to the adapter while said adapter remains rotationally locked within said mated opening in the radio cabinet.

2. A quick release antenna mount as in claim 1 further comprising:

a portable radio cabinet having an antenna connection opening with a radially inwardly extending slot for receiving said tab; and said opening having a ball spring biased radially inwardly of the opening for entry into said notch.

3. A quick release antenna mount as in claim 1 or 2 wherein said adapter is spring-biased by a spring bearing against a retention pin extending through said conductive shaft and circumferentially aligned with said tab, and said retention pin extending radially outwardly asymmetrically so as to extend a greater distance on the side opposite said tab.

4. A quick release antenna mount as recited in claim 3 wherein said adapted is slidably carried by an exposed end of said conductor shaft between said retention pin and said spring on one side and a locking pin at the other side.

5. A quick release antenna mount as in claim 1 or 2 wherein a locking pin includes a retention pin extending through said conductive shaft and mated to fit within one of a plural of radially extending recesses in an adjacent end of said adapter.

6. A quick release antenna mount as recited in claim 5, wherein said adapter is slidably carried by an exposed end of said conductor shaft between said retention pin and said spring on one side and a locking pin at the other side.

7. A quick release antenna mount comprising:

an adapter axially slidable about an RF conductive shaft, said conductive shaft having an RF connection at one end and an RF antenna at the other end, one end of said adaptor having an inner opening diameter larger than the other;

said adapter having an outer surface sized and configured to fit within a mated opening in a portable radio cabinet, said outer surface having means for effecting a quick release locking of the adapter to both rotational and axial movements with respect to said mated opening in the radio cabinet; and said adapter further including a multiple position detent to permit selective rotational movements of the RF conductive shaft to a plurality of predetermined positions with respect to the adapter while and adapter means rotationally locked within said mated opening in the radio cabinet.

8. A quick release radio antenna mount comprising:

an adapter axially slidable about an RF conductive shaft, said conductive shaft having an RF connection at one end and an RF antenna at the other end, one end of said adaptor having a central opening which extends inwardly a distance greater than a central opening at the other end;

said adapter having an outer surface sized and configured to fit within a mated opening in a portable radio cabinet, said outer surface having means for effecting a quick release locking of the adapter to both rotational and axial movements with respect to said mated opening in the radio cabinet; and said adapter further including a multiple position detent to permit selective rotational movements of the RF conductive shaft to a plurality of predetermined positions with respect to the adapter while said adapter remains rotationally locked within said mated opening in the radio cabinet.

9. A quick release antenna mount comprising:

an adapter axially slidable about an RF conductive shaft, said conductive shaft having an RF connection at one end and an RF antenna at the other end;

said adapter having an outer surface sized and configured to fit within a mated opening in a portable radio cabinet, said outer surface having means for effecting a quick release locking of the adapter to both rotational and axial movements with respect to said mated opening in the radio cabinet; and said adapter further including a multiple position detent to permit selective rotational movements of the RF conductive shaft to a plurality of predetermined positions with respect to the adapter while said adapter remains rotationally locked within said mated opening in the radio cabinet, one end of said adapter having a four position locking arrangement for releasably locking the antenna to one of four possible rotational positions within the radio cabinet opening.

10. A quick release radio frequency antenna comprising:

a radio frequency antenna having an RF conductive shaft;

an adapter through which the conductive shaft slidably extends, the adapter being sized and configured to fit within a mated opening in a radio cabinet, the adapter having a central axis and an axial aperture through which the conductive shaft slidably extends, the adapter further having an axial end surface provided with means for defining a plurality of detent positions angularly oriented about the central axis;

retention means selectively positionable in a retention position for limiting the extent to which the conductive shaft is slidable with respect to the radio cabinet and selectively positionable in a release position for permitting the conductive shaft and adapter to be removed from the radio cabinet;

means provided on the adapter for rotationally and axially locking the adapter from movement with respect to the radio cabinet when the adapter is fitted in the radio cabinet and when the retention means is in the retention position;

a locking member mounted on the conductive shaft, the locking member being configured to mate with at least one of the detent positions defined on the adapter; and means for positionally biasing the adapter and the locking member with respect to one another.

11. The apparatus of claim 10, wherein, when the adapter is locked by the locking means with respect to the radio cabinet, and when the biasing means is overcome by a force being applied to the conductive shaft, the conductive shaft and the locking member mounted thereon are angularly rotatable whereby the locking member mates with a selected one of the detent positions on the adapter.

12. A quick release radio frequency antenna comprising:

an RF conductive shaft having a first end thereof engageable with an RF connection and an RF antenna at a second end thereof;

a radio cabinet having an opening therein;

an adapter having a peripheral outer surface which is fittable within the opening in the radio cabinet, the adapter having a central axis and an axial aperture through which the RF conductive shaft slidably extends, the adapter further having the axial end surface provided with means for defining a plurality of detent positions angularly oriented about the central axis;

a locking member mounted on the RF conductive shaft, the locking member being configured to mate with at lest one of the detent positions defined on the adapter;

means for positionally biasing the adapter and the locking member with respect to one another;

means provided on the adapter for rotationally and axially locking the adapter from movement with respect to the radio cabinet when the adapter is fitted in the radio cabinet;

wherein, when the adapter is locked by the locking means with respect to the radio cabinet, and when the biasing means is overcome by a force being applied to the RF conductive shaft, the RF conductive shaft and the locking member mounted thereon are angularly rotatable whereby the locking member mates with a selected one of the detent positions on the adapter.

13. The apparatus of claim 12 or 11 wherein the locking member is a locking pin extending radially through the RF conducting shaft, and wherein the means for defining a plurality of detent positions comprises a plurality of radial channels formed on the axial end surface of the adapter, the locking pin being configured to fit into the radial channels.

14. The apparatus of claim 12 or 11 further comprising a retaining member mounted on the RF conductive shaft, with the adapter being positionally maintained between the locking member and the retaining member, the retaining member being configured for selective engagement with the radio cabinet.

15. The apparatus of claim 12 or 11, wherein the locking means provided on the adapter includes a radially outwardly extending tab, and wherein the opening in the radio cabinet has a radially extending slot with which the tab mates when the adapter is fitted into the radio cabinet.

16. The apparatus of claim 15, further comprising a retaining member radially mounted on the RF conductive shaft, with the adapter being positionally maintained between the locking member and the retaining member, the retaining member being angularly rotatable about the axis of the RF conductive shaft to a position aligned with the tab for permitting the adapter to be removed from the radio cabinet.

* * * * *